US006739306B2

(12) United States Patent
Linsbauer et al.

(10) Patent No.: US 6,739,306 B2
(45) Date of Patent: May 25, 2004

(54) INTAKE ARRANGEMENT FOR COMBUSTION AIR

(75) Inventors: Peter Linsbauer, Remshalden (DE); Jürgen Erath, Stuttgart (DE); Joachim Hoffman, Plochingen (DE); Ulf Nägele, Murr (DE); Hans Bernhard Sponner, Stuttgart (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 10/162,901

(22) Filed: Jun. 6, 2002

(65) Prior Publication Data

US 2002/0189572 A1 Dec. 19, 2002

(30) Foreign Application Priority Data

Jun. 13, 2001 (DE) ..... 101 28 789

(51) Int. Cl.[7] ..... F02M 35/08
(52) U.S. Cl. ..... 123/198 E
(58) Field of Search ..... 123/184.21, 198 E; 55/434, 437, 467, 473

(56) References Cited

U.S. PATENT DOCUMENTS 3,838,675 A 10/1974 Schaeffer
3,884,658 A 5/1975 Roach
4,233,043 A * 11/1980 Catterson ..... 55/315
5,231,956 A * 8/1993 Lux et al. ..... 123/198 E
5,343,831 A * 9/1994 Collins ..... 123/198 E
5,526,777 A * 6/1996 Taomo et al. ..... 123/198 E
5,746,160 A * 5/1998 Stark et al. ..... 123/198 E

* cited by examiner

*Primary Examiner*—Marguerite McMahon
(74) *Attorney, Agent, or Firm*—Walter Ottesen

(57) ABSTRACT

The invention relates to an intake arrangement (1) for the combustion air (2) of an internal combustion engine (3) of a handheld portable work apparatus (4), such as a cutoff machine, motor-driven chain saw or the like. An air filter (5) is provided for purifying the combustion air (2). Dust-laden combustion air is directed onto the air filter via openings (6) of a filter housing (7). The combustion air (2) is purified by the air filter (5) and is drawn by suction by the engine (3) via an intake pipe (25) of a carburetor (8). A carrier airflow (10) is provided in a flow channel (15) for continuously or intermittently transporting away dust (11) deposited on the air filter (5). The combustion air (2) and the carrier airflow (10) are spatially separated via a discharge tube (13). In this way, a minimization of the dust load of the air filter (5) is ensured on the one hand and a continuous transport away of the dust (11) from the air filter (5) is ensured on the other hand. The removal transport of the dust (11) ensures continuous operation of the work apparatus (4).

11 Claims, 2 Drawing Sheets

INTAKE ARRANGEMENT FOR COMBUSTION AIR

FIELD OF THE INVENTION

The invention relates to an intake arrangement for combustion air of an internal combustion engine.

BACKGROUND OF THE INVENTION

U.S. Pat. No. 5,526,777 discloses an intake arrangement for an internal combustion engine in a portable handheld work apparatus. An air filter is provided in a filter housing for purifying the combustion air. Unfiltered air is conveyed through an opening into the filter housing by the cooling blower of the engine and is moved along the air filter. The carburetor of the engine is connected to the clean air side of the filter housing and the engine draws dust-free combustion air into a combustion chamber of the engine via the air filter. When an intensely dirty ambient is present as is often the case for cutoff machines, the dust, which is contained in the air, deposits on the air filter and quickly clogs the same. For this reason, the power developed by the engine is affected. The large dust load of the air filter requires frequent cleaning so that a maintenance intensive operation of the engine results.

SUMMARY OF THE INVENTION

It is an object of the invention to provide an intake arrangement for the combustion air of an internal combustion engine with which a low maintenance continuous operation of the engine is provided with a minimized dust load of the air filter even with heavily dust-laden ambient air.

The intake arrangement for combustion air of the invention is for an internal combustion engine including an internal combustion engine of a portable handheld work apparatus. The engine includes a carburetor toward which combustion air laden with dust is drawn by the engine. The intake arrangement includes: an air filter assembly mounted upstream of the carburetor for purifying the combustion air of the dust; the air filter assembly including a filter housing and an air filter mounted in the filter housing for separating the dust from the combustion air; the air filter delimiting a contaminant space in the filter housing where the dust deposits and is separated from the combustion air; the filter housing having an opening formed therein through which the combustion air laden with dust passes into the contaminant space; and, carrier airflow means operatively connected to the contaminant space for conducting away the separated dust in a carrier airflow.

In the intake arrangement, means for conducting away the dust separated from the combustion air is provided on the side of the contaminant space and a carrier airflow is used for this purpose. The dust load of the air filter is reduced in this manner and a continuous discharge of dust separated at the air filter is ensured. The combustion air for the engine first flows into a contaminant space via an opening in the filter housing. The contaminant space is delimited by the filter housing and the filter. The combustion air is guided through the air filter with the dust or contaminants being separated and the combustion air then enters into a crankcase via an intake pipe section in the carburetor of the engine and into the combustion chamber of the engine. A discharge tube is connected to the contaminant space and connects the contaminant space of the filter housing to a flow channel. The carrier airflow is conducted in the flow channel. If dust drops from the air filter during operation of the work apparatus, then the contaminant reaches the discharge tube and is conducted away by the carrier airflow.

The flow channel is mounted approximately transversely to the discharge tube. In this way, a static pressure or underpressure is developed in the opening region of the discharge tube in the flow channel and this static pressure or underpressure supports the discharge of the filter cake or contaminant from the contaminant space and the discharge tube. It can be practical to permit the discharge tube to open into the flow channel at an acute angle. With this constructive measure, a suction action of the carrier airflow in the discharge tube is increased.

The geometric disposition of the flow direction of the combustion air in the filter housing relative to the discharge tube is so selected that the combustion air is so guided in the contaminant space of the filter housing that the combustion air runs at least transversely to the conveying direction of the contaminant or filter cake in the discharge tube. For this purpose, the longitudinal center axis of the opening for the entry of combustion air is arranged transversely to the discharge tube. In order to keep coarse contaminant particles from the contaminant space of the filter housing, it is practical to provide a plurality of openings in lieu of one opening to the entry of the combustion air. The diameter or cross-sectional area of the plurality of openings can then be selected smaller than that of a single opening.

The air filter is preferably formed as a flat structure having a rectangular, quadratic or circularly-shaped outline. The air filter spans a filter plane to which the longitudinal center axis of the discharge tube is aligned so as to be parallel or approximately perpendicular.

The discharge tube, which is arranged approximately perpendicular in the work position of the work apparatus (that is, directed to the earth center point), opens into the filter housing in a funnel-like manner expanding under the air filter. In this way, the contaminant or filter cake which drops off of the air filter can reach the discharge tube under the action of gravity.

The blower, which generates the carrier airflow is preferably a cooling air blower of the engine. The air filter is preferably configured as a planar or folded paper air filter.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
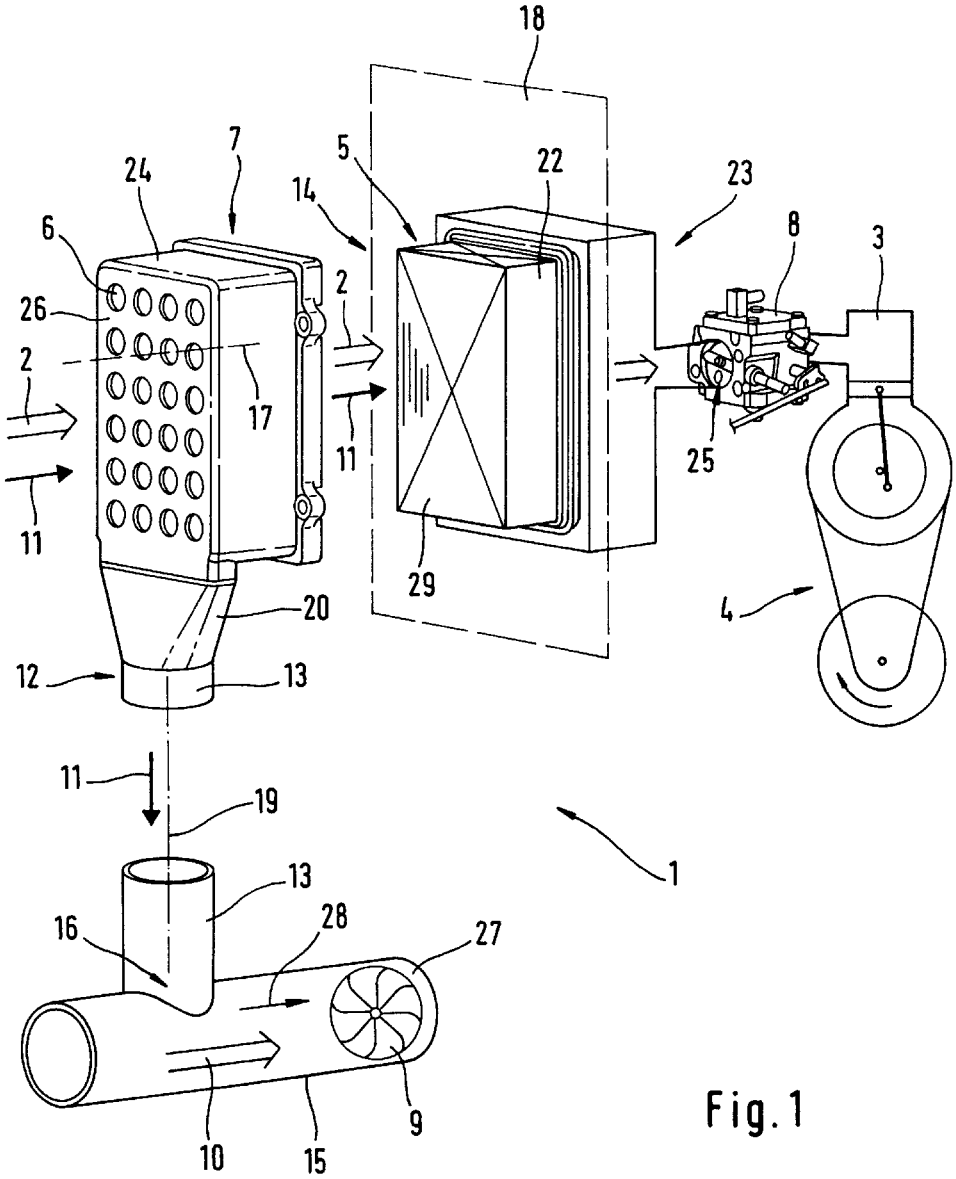
FIG. 1 is an exploded view of an intake arrangement according to an embodiment of the invention; and, FIG. 2 is a schematic exploded view of another embodiment of an intake arrangement of the invention.

FIG. 1 shows an intake arrangement 1 for the combustion air 2 of an internal combustion engine 3. The engine 3 drives a schematically represented portable handheld work apparatus 4, which is shown here as a cutoff machine by way of example. The internal combustion engine 3 is suitable for driving other portable handheld work apparatus such as a motor-driven chain saw, a metal-cutting machine or the like.

The intake arrangement 1 shown is especially advantageous for work apparatus wherein large quantities of dirt or contaminants are present such as air-entrained dust 11 or the like as is the case with the use of cutoff machines such as in road building. The combustion air for the internal combustion engine of such apparatus has to be purified from the dust 11. The dust 11 in the combustion air 2, which is drawn in by the work apparatus 4, is to be continuously or intermittently disposed of by the work apparatus 4. For this purpose, the intake arrangement 1 is provided with an air filter 5 which is advantageously configured as a planar or folded paper filter 22. The air filter 5 is disposed in a filter housing 7. The filter housing 7 is partitioned by the air filter 5 into a contaminant space 14 and a clean space 23.

On the side of the contaminant space, the air filter 5 is surrounded on all sides by a trough-shaped filter housing cover 24. On the clean space side, which lies opposite the contaminant space 14, the air filter 5 is connected to a housing of a carburetor 8, especially to an intake pipe 25 configured in the carburetor 8. The filter housing cover 24 has a wall 26 lying opposite the air filter 5. The cover 24 includes four rows of openings 6 in the wall 26 for the entry of contaminated combustion air 2 laden with dust.

The combustion air 2 is purified during the operation of the engine 3 at the air filter 5 and flows, enriched with fuel, through the intake pipe 25 and into a crankcase and a combustion chamber in the engine 3. The flow of the combustion air is effected by pressure fluctuations generated by a rotating or reciprocating piston in the engine 3.

During the operation of engine 3, dust 11 deposits on the air filter 5 at the contaminant space side 14. The dust intensifies to become a dust layer or a filter cake after a certain duration of operation of the engine 3. Especially in work apparatus which are operated in especially dust-containing ambient air, considerable quantities of dust deposit on the air filter 5 in a short time. For this reason, a continuous or intermittent removal of the occurring dust or of the forming filter cake from the contamination space 14 in the filter housing cover 24 is necessary.

Figure 2:
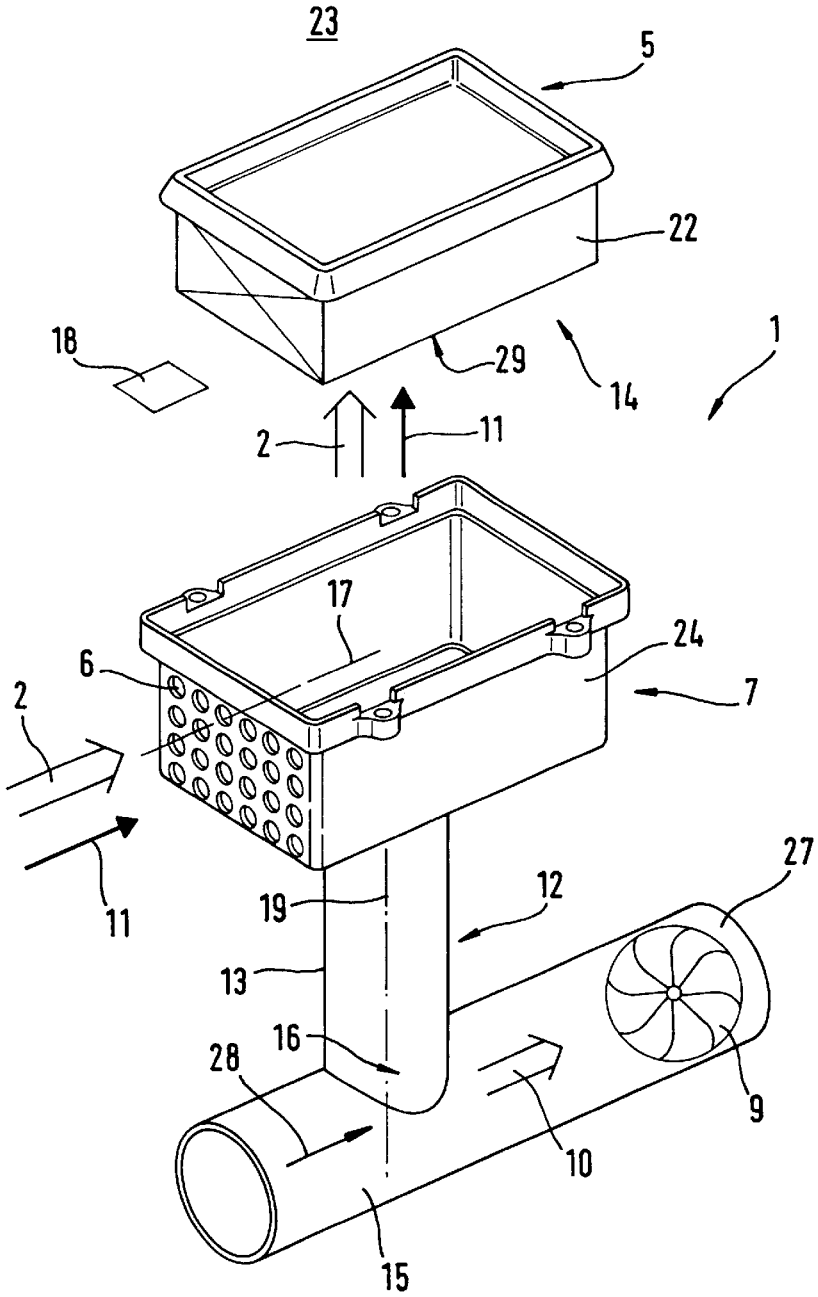

As also shown in FIG. 2 in a view of a further intake arrangement 1, a carrier airflow 10 is provided for this purpose. The carrier airflow 10 is conducted in a flow channel 15 at a spacing to the filter housing 7. The carrier airflow 10 is generated by a blower 9 at an end 27 of the flow channel 15. In FIGS. 1 and 2, this blower is an axial blower which is mounted in the flow channel 15. In lieu of an axial blower, it can be practical to utilize a radial blower. It is further practical to utilize a cooling air blower of the engine 3 for generating the carrier airflow 10.

A discharge tube 13 for fluidly connecting the contaminant space side 14 of the filter housing 7 to the flow channel 15 is provided for conducting dust out of the filter housing 7, especially from the filter housing cover 24 into the carrier airflow 10 of the flow channel 15. The discharge tube 13 is approximately transverse to the carrier airflow 10 at least in the opening region 16 of the discharge tube. It can be practical to allow the discharge tube 13 to open at an acute angle to the flow channel 15 in the flow direction 28 of the carrier airflow 10 at the opening region 16. In this way, a static or underpressure is present in the discharge tube 13 at the opening region 16.

In the work position of the work apparatus 4, the longitudinal center axis 19 of the discharge tube 13 is aligned approximately perpendicularly, that is, parallel to the gravitational force toward the earth center point. It is practical to configure a wall 20 of the filter housing 7, especially of the filter housing cover 24, to have a funnel shape tapered toward the discharge tube 13. In this way, dust 11, which adheres to the air filter 5, can separate under the action of the inertial forces during operation of the work apparatus 4 and drop into the discharge tube 13 under the action of gravity.

As shown in FIGS. 1 and 2, the respective longitudinal center axes 17 of the openings 6 for the entry of combustion air 2 at the filter housing cover 24 are arranged approximately transversely to the discharge tube 13. In this way, the fluid flows of combustion air 2 in the filter housing 7 and dust 11 in the discharge tube 13 run separate from each other with respect to direction.

In the embodiments shown in FIGS. 1 and 2, the air filter 5 is a flat-shaped structure and spans a filter plane 18 with its contaminant space side projection surface 29. In FIG. 1, the air filter is so mounted in the filter housing 7 relative to the discharge tube 13 that the longitudinal center axis 19 of the discharge tube 13 is aligned approximately parallel to the filter plane 18. In contrast, the air filter 7 in FIG. 2 is arranged relative to the discharge tube 13 so that the longitudinal center axis 19 of the discharge tube 13 is aligned approximately perpendicularly to the filter plane 18. The combustion air 2 is therefore deflected by approximately 90° in the filter housing 7 in FIG. 2 on its path from the contaminant space to the air filter 5 so that the flow direction of the combustion air 2 on the contaminant space side 14 is opposite to the drop direction of the dust 11, that is, of the filter cake in the discharge tube 13.

It is understood that the foregoing description is that of the preferred embodiments of the invention and that various changes and modifications may be made thereto without departing from the spirit and scope of the invention as defined in the appended claims.

What is claimed is:

1. An intake arrangement for combustion air of an internal combustion engine including an internal combustion engine of a portable handheld work apparatus, the engine including a carburetor toward which combustion air laden with dust is drawn by said engine, the intake arrangement comprising:

an air filter assembly mounted upstream of said carburetor for purifying said combustion air of said dust;

said air filter assembly including a filter housing and an air filter mounted in said filter housing for separating said dust from said combustion air;

said air filter delimiting a contaminant space in said filter housing where said dust deposits and is separated from said combustion air;

said filter housing having an opening formed therein through which said combustion air laden with dust passes into said contaminant space;

carrier airflow means operatively connected to said contaminant space for conducting away the separated dust in a carrier airflow; and, said carrier airflow means including: a flow path for conducting said carrier airflow spatially separated from said combustion air; and, a discharge tube for connecting said contaminant space to said flow oath so that said dust separated out by said air filter is discharged through said discharge tube and transported away by said carrier airflow.

2. The intake arrangement of claim 1, wherein said flow path is a flow channel and said discharge tube and said flow channel conjointly define an opening region whereat said discharge tube opens into said flow channel; and, said flow channel is disposed relative to said discharge tube so that said carrier airflow runs approximately transversely to said discharge tube and so that a partial vacuum is generated which reinforces the removal of said dust.

3. The intake arrangement of claim 2, wherein said opening defines a longitudinal axis running approximately transversely to said discharge tube.

4. The intake arrangement of claim 3, wherein said filter housing has a plurality of said openings for permitting the entry of said combustion air laden with dust into said contaminant space.

5. The intake arrangement of claim 2, wherein said discharge tube is mounted so as to be approximately vertical when said work apparatus is in its work position so as to cause dust adhering to said air filter to be guided under the force of gravity into said discharge tube.

6. The intake arrangement of claim 2, wherein said air filter is a planar or folded paper filter.

7. An intake arrangement for combustion air of an internal combustion engine including an internal combustion engine of a portable handheld work apparatus, the engine including a carburetor toward which combustion air laden with dust is drawn by said engine, the intake arrangement comprising:

an air filter assembly mounted upstream of said carburetor for purifying said combustion air of said dust;

said air filter assembly including a filter housing and an air filter mounted in said filter housing for separating said dust from said combustion air;

said air filter delimiting a contaminant space in said filter housing where said dust deposits and is separated from said combustion air;

said filter housing having an opening formed therein through which said combustion air laden with dust passes into said contaminant space;

carrier airflow means operatively connected to said contaminant space for conducting away the separated dust in a carrier airflow; and, said carrier airflow means comprising:

a flow channel for conducting said carrier airflow spatially separated from said combustion air;

a discharge tube for connecting said contaminant space to said flow channel;

said discharge tube and said flow channel conjointly defining an opening region whereat said discharge tube opens into said flow channel;

said flow channel being disposed relative to said discharge tube so that said carrier airflow runs approximately transversely to said discharge tube; and, said air filter assembly being a flat structure and spanning a filter plane.

8. The intake arrangement of claim 7, wherein said air filter defines a filter plane; and, said discharge tube defines a longitudinal center axis aligned approximately parallel to said filter plane.

9. The intake arrangement of claim 7, wherein said air filter defines a filter plane; and, said discharge tube defines a longitudinal center axis aligned approximately perpendicular to said filter plane.

10. An intake arrangement for combustion air of an internal combustion engine including an internal combustion engine of a portable handheld work apparatus, the engine including a carburetor toward which combustion air laden with dust is drawn by said engine, the intake arrangement comprising:

an air filter assembly mounted upstream of said carburetor for purifying said combustion air of said dust;

said air filter assembly including a filter housing and an air filter mounted in said filter housing for separating said dust from said combustion air;

said air filter delimiting a contaminant space in said filter housing where said dust deposits and is separated from said combustion air;

said filter housing having an opening formed therein through which said combustion air laden with dust passes into said contaminant space;

carrier airflow means operatively connected to said contaminant space for conducting away the separated dust in a carrier airflow; and, said carrier airflow means comprising:

a flow channel for conducting said carrier airflow spatially separated from said combustion air;

a discharge tube for connecting said contaminant space to said flow channel;

said discharge tube and said flow channel conjointly defining an opening region whereat said discharge tube opens into said flow channel;

said flow channel being disposed relative to said discharge tube so that said carrier airflow runs approximately transversely to said discharge tube;

said filter housing having a wall to which said discharge tube is connected; and, said wall having a funnel-like shape leading tapered to said discharge tube.

11. An intake arrangement for combustion air of an internal combustion engine including an internal combustion engine of a portable handheld work apparatus, the engine including a carburetor toward which combustion air laden with dust is drawn by said engine, the intake arrangement comprising:

an air filter assembly mounted upstream of said carburetor for purifying said combustion air of said dust;

said air filter assembly including a filter housing and an air filter mounted in said filter housing for separating said dust from said combustion air;

said air filter delimiting a contaminant space in said filter housing where said dust deposits and is separated from said combustion air;

said filter housing having an opening formed therein through which said combustion air laden with dust passes into said contaminant space;

carrier airflow means operatively connected to said contaminant space for conducting away the separated dust in a carrier airflow; and, said carrier airflow means comprising:

a flow channel for conducting said carrier airflow spatially separated from said combustion air;

a discharge tube for connecting said contaminant space to said flow channel;

said discharge tube and said flow channel conjointly defining an opening region whereat said discharge tube opens into said flow channel;

said flow channel being disposed relative to said discharge tube so that said carrier airflow runs approximately transversely to said discharge tube;

said carrier flow means further including a blower for generating said carrier airflow; and, said blower being a cooling air fan of said internal combustion engine.

* * * * *